United States Patent [19]

Armstrong et al.

[11] 4,226,733

[45] Oct. 7, 1980

[54] LUBRICANT COMPOSITIONS STABILIZED AGAINST ULTRA-VIOLET DEGRADATION

[75] Inventors: Eldon L. Armstrong, Mullica Hill; Samuel J. Leonardi, Pitman, both of N.J.

[73] Assignee: Mobil Oil Corporation, New York, N.Y.

[21] Appl. No.: 961,792

[22] Filed: Nov. 17, 1978

Related U.S. Application Data

[60] Division of Ser. No. 755,283, Dec. 29, 1976, which is a continuation-in-part of Ser. No. 604,977, Aug. 15, 1975, abandoned.

[51] Int. Cl.[2] ..... C10M 1/54

[52] U.S. Cl. ..... 252/42.7; 252/32.7 E; 252/33.6; 252/46.4; 252/47.5

[58] Field of Search ..... 252/32.7 E, 33.6, 35, 252/42.7, 47.5, 49.7, 46.4

[56] References Cited

U.S. PATENT DOCUMENTS

| | | | |
|---|---|---|---|
| 2,518,379 | 8/1950 | Rogers et al. | 252/42.7 X |
| 2,703,786 | 3/1955 | Young et al. | 252/42.7 |
| 2,716,090 | 8/1955 | Hakala et al. | 252/42.7 |
| 2,734,867 | 2/1956 | Weissberg et al. | 252/42.7 |
| 2,763,613 | 9/1956 | Scott et al. | 252/42.7 X |
| 2,913,412 | 11/1959 | Moore et al. | 252/42.7 |
| 2,947,695 | 8/1960 | Leshin et al. | 252/33.6 |
| 3,149,077 | 9/1964 | Davis | 252/32.7 E X |
| 3,210,277 | 10/1965 | Swift | 252/42.7 |
| 3,244,627 | 4/1966 | Smith et al. | 252/33.6 |
| 3,252,910 | 5/1966 | Oberright | 252/42.7 |
| 3,313,770 | 4/1967 | Foster | 260/45.75 |
| 3,368,972 | 2/1968 | Otto | 252/47.5 |
| 3,428,662 | 2/1969 | Millendorf et al. | 252/32.7 E X |
| 3,450,636 | 6/1969 | Rausch | 252/32.7 E X |
| 3,630,897 | 12/1971 | Rohde et al. | 252/33.6 |
| 3,654,329 | 4/1972 | Imparato et al. | 252/32.7 E X |
| 3,764,534 | 10/1973 | Blejean et al. | 252/42.7 |

*Primary Examiner*—Andrew Metz

*Attorney, Agent, or Firm*—Charles A. Huggett; Raymond W. Barclay; Howard M. Flournoy

[57] ABSTRACT

Lubricant compositions are provided which contain an effective amount of a nickel complex, e.g., a nickel phenol-phenolate derivative of a phenol sulfide for stabilizing said compositions against ultra-violet degradation.

9 Claims, No Drawings

LUBRICANT COMPOSITIONS STABILIZED AGAINST ULTRA-VIOLET DEGRADATION

CROSS REFERENCE TO RELATED APPLICATIONS

This is a division of copending application Ser. No. 755,283, filed Dec. 29, 1976 which is a Continuation-in-Part of Ser. No. 604,977; filed Aug. 15, 1975, now abandoned.

BACKGROUND OF THE INVENTION

1. Field of the Invention

This invention relates to lubricant compositions, and relates more particularly to lubricant compositions normally subject to degradation by ultra-violet light present in for example such sources of actinic radiation as sunlight. Still more particularly, the invention relates to lubricant compositions, such as oils of lubricating viscosity, e.g., hydrocracked lubricating oils, hydraulic oils, automotive oils, gear oils, transmission fluids, waxes, greases and other forms of lubricants normally requiring the presence of stabilizing agents against the degradative effects of ultra-violet light.

2. Description of the Prior Art

In general, the production of lubricant compositions, for example, lubricating oils produced by hydrocracking affords a relatively high viscosity index and permits the use of certain stocks that would be unsuitable for other processes. On the other hand, however, hydrocracked lubricating oils tend toward poor stability against ultra-violet light degradation, rapidly forming suspended and/or precipitated insoluble material on exposure to ultra-violet light, such as sunlight, or other sources of actinic radiation. Compounds capable of absorbing ultra-violet light, for example, hydroxybenzophenones and hydroxyphenyl benzotriazoles, have afforded some improvement in the light stability of hydrocracked oils. Conventional antioxidants have also provided some benefit.

In the literature, Heskins and Guillet in "Mechanism of Ultraviolet Stabilization of Polymers", Macromolecules 1, 97 (1968), first proposed the energy transfer mechanism of ultra-violet protection. Commercially available ultra-violet stabilizers are also listed by class and function and identified as to structure in the Kirk-Othmer Encyclopedia in "Encyclopedia of Chemical Technology"; Second Edition, Vol. 21, pp. 115–122. Uri in "Thermal and Photochemical Oxidation of Polymers and Its Prevention", Chemistry and Industry, Mar. 1, 1975, pp. 199–203, cites conventional antioxidant effects (hydroperoxide decomposition and free radical capture) of bis (stilbenedithiolato) nickel and its ultra-violet inhibiting properties. In British Patent Specification No. 1,263,910 (1972), there is disclosed bis (stilbenedithiolato) nickel as an antioxidant for plastic materials. The specification also cites the superior hydroperoxide decomposition capability of this additive. U.S. Pat. No. 3,832,304, discloses the use of aromatic azo compounds for stabilizing hydrocracked oils. Additionally in the patent literature, for example, U.S. Pat. Nos. 3,149,077; 3,448,662; 3,450,636 and 3,654,329 disclose the use of nickel salts complexed with dithiophosphorous compounds as being useful in lube oils and functional fluids. Further, U.S. Pat. Nos. 2,703,786; 2,716,090 and 3,210,277 disclose the use of polyvalent (e.g. Ni) metal salts of alkyl phenol sulfides as oxidation inhibitors and plasticizing agents. Various other polyvalent metal (e.g. nickel) compounds are disclosed in the patent literature, for example U.S. Pat. No. 3,630,897 discloses metal salts (e.g. nickel, iron, zinc) of substituted dithiocarbamic acids and U.S. Pat. No. 3,252,910 discloses compounds such as nickel N,N-substituted dithiooxamides. U.S. Pat. Nos. 2,971,940 and 2,971,941 disclose nickel phenol-phenolate complexes as being useful in stabilizing polyethylene and polypropylene. U.S. Pat. Nos. 3,215,717 and 3,313,770 disclose certain nickel amine sulfide complexes as being useful for stabilizing various polyolefinic plastic materials. To the best of applicants' knowledge the lubricant compositions containing the nickel complexes described herein have not heretofore been disclosed.

SUMMARY OF THE INVENTION

In accordance with the present invention, we have found that degradation, due to ultra-violet light, present in sunlight or other sources of actinic radiation, can be effectively inhibited in lubricant compositions by the incorporation therein of certain organo sulfur-containing nickel complexes. These nickel complexes are particularly effective against ultra-violet degradation in such lubricating media as oils of lubricating viscosity which include hydrocracked lubricating oils, hydraulic oils, automotive oils, gear oils, transmission fluids, waxes, greases and other forms of lubricant compositions normally requiring the presence of stabilizing agents against the degradation effect of ultra-violet light. The aforementioned, oils of lubricating viscosity include mineral oils or fractions thereof, synthetic oils or fractions thereof.

The nickel complexes embodied herein can be effectively employed in any amount which is sufficient for imparting to the lubricant the desired degree of protection against ultra-violet degradation. In many instances, the nickel complex is effectively employed in an amount from about 0.01 to about 5% by weight, and preferably in an amount from about 0.1 to about 2%, by weight of the total weight of the lubricant composition. The term "nickel complex", as used herein is intended to include nickel compounds having a chelate ring formation. As hereinbefore indicated, the organic nickel complexes may be incorporated in any lubricating media which can include oils of lubricating viscosity and also greases in which any of the aforementioned oils are employed as vehicles. In general, synthetic oils can also be effectively protected against ultra-violet degradation or may also be employed in combination with mineral oils, or as grease vehicles. Typical synthetic vehicles include polyisobutylene, polybutenes, hydrogenated polydecenes, polypropylene glycol, polyethylene glycol, trimethylol propane esters, neopentyl and pentaerythritol esters, di(2-ethyl hexyl) sebacate, di(2-ethyl hexyl) adipate, dibutyl phthalate, fluorocarbons, silicate esters, silanes, esters of phosphorous-containing acids, liquid ureas, ferrocene derivatives, hydrogenated mineral oils, chain-type polyphenols, siloxanes and silicones (polysiloxanes), alkyl-substituted diphenyl ethers typified by a butyl-substituted bis-(p-phenoxy phenyl) ether, phenoxy phenylether, etc.

Particularly desirable nickel complexes in accordance with the present invention include commercially available nickel alkylphenol-phenolate sulfides, amine complexes of nickel alkylphenolate sulfides, nickel alkyldithiophosphates and nickel alkyldithiocarbamates.

The nickel phenol-phenolate sulfides employed herein, for example, have the following structure:

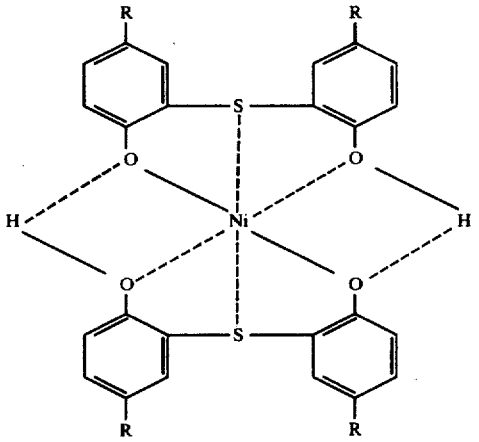

I in which R is either hydrogen or an alkyl group having from 1 to about 30 carbon atoms.

Representative of the nickel phenol-phenolates is a nickel phenol-phenolate of t-octylphenol sulfide having the above structure in which R is $C_8H_{17}$.

Representative of the amine complexes of nickel phenolate sulfides is [2,2'-thio-bis(4-tert-octylphenolato)]-n-butylamine nickel having the structure

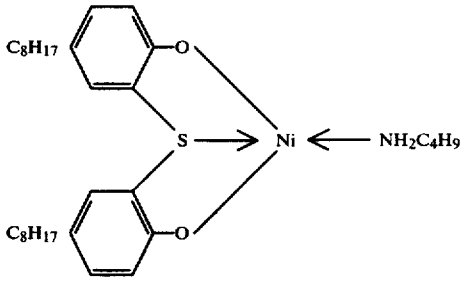

II

Representative of the nickel dithiophosphates is nickel di(4-methyl-2-pentyl)dithiophosphate having the structure

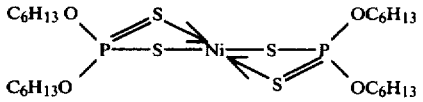

III

Representative of the nickel dithiocarbamates is nickel dibutyl dithiocarbamate having the structure

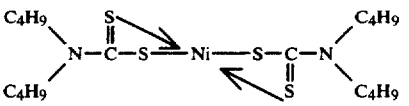

IV

Accordingly this application is directed to a lubricant composition comprising a major amount of a lubricant base and a minor amount of a nickel complex effective for stabilizing said composition against ultra-violet degradation in which said complex is selected from the group consisting of $C_1$-$C_{30}$ amine complexes of nickel alkyl phenolate sulfides, nickel alkyl dithiocarbamates, nickel alkyl dithiophosphates, and nickel alkyl phenol-phenolate sulfides, said alkyl group having from 1 to about 30 carbon atoms. Most preferred however of the above described complexes are the nickel phenol-phenolate sulfides. Therefore, this application is particularly directed to lubricant compositions comprising a major amount of a lubricant base and a minor amount of a nickel phenol-phenolate sulfide, effective to stabilize said composition against ultra-violet degradation, having the previously indicated general structure I, in which R is hydrogen or an alkyl group having from 1 to about 30 carbon atoms and preferably from about 4 to about 8 carbon atoms. Most preferred is the phenol-phenolate sulfide wherein R is $C_8H_{17}$; i.e., t-octyl.

DESCRIPTION OF SPECIFIC EMBODIMENTS

In order to evaluate the effectiveness of the nickel complexes of the present invention against ultra-violet degradation in lubricant media, the following test was employed:

This test utilized a base oil, viz. a hydrofinished hydrocracked "100" oil obtained by dewaxing 725° F. bottoms from a first-stage product of a fuel hydrocracker. Blends of additives with the aforementioned hydrocracked base oil were tested by subjecting 20 grams of the test oil in a capped four-ounce tall form bottle to daylight on a window sill with a southeast exposure. The test oil was observed each day for suspended insoluble products, which usually progress from a haze to a suspended floc and precipitates, which generally are preceded by hazes or flocs, and often consist of settled haze or floc. Table I records the results obtained employing 0.1 weight percent additives in the aforementioned hydrocracked base oil. From the table, it will be noted that the nickel complexes of the present invention are much more markedly effective against ultra-violet degradation (Examples 2–6) than the best of the commercially available antioxidants and ultra-violet adsorbers (Examples 7–11).

TABLE I

Daylight Exposure Tests of Hydrocracked Base Stock Containing 0.1 Wt. % Additives

| | | Number of Days/Condition | | | |
|---|---|---|---|---|---|
| Ex. | Additive | 1 | 4 | 8 | 12 |
| 1 | None (Base Oil) | Slightly hazy | Hazy, heavy Ppt. | | |
| 2 | Nickel phenol-phenolate of t-octylphenol sulfide (6.0 wt. % Ni) | Clear | Very slightly hazy | Slightly hazy | Hazy, heavy Ppt. |
| 3 | Nickel phenol-phenolate of t-octylphenol sulfide (7.7 wt. % Ni) | Clear, light Ppt. | Very slightly hazy, Lt Ppt. | Slightly hazy, Lt Ppt. | Hazy, heavy Ppt. |
| 4 | [2,2'-thio-bis(4-tert-octylphenolato)]-n- | Clear | Hazy | Suspended Floc, | |

TABLE I-continued

| Ex. | Additive | Daylight Exposure Tests of Hydrocracked Base Stock Containing 0.1 Wt. % Additives — Number of Days/Condition: 1 | 4 | 8 | 12 |
|---|---|---|---|---|---|
| | butylamine nickel | | | Heavy Ppt. | |
| 5 | Nickel dibutyl dithio carbamate | Clear | Slightly hazy, Medium Ppt. | Slightly hazy, heavy Ppt. | Lt suspended Floc, hvy Ppt. |
| 6 | Nickel di(4-methyl-2-pentyl)dithiophosphate | Clear | Lt suspended Floc, hvy Ppt. | Suspended Floc heavy Ppt. | |
| 7 | Di-t-butyl para cresol | Clear | Suspended Floc, Medium Ppt. | | |
| 8 | Phenyl alpha-naphthylamine | Clear | Suspended Floc, Medium Ppt. | | |
| 9 | Zinc di(4-methyl 2-pentyl) dithiophosphate | Clear | Slightly hazy, Trace Ppt. | Suspended Floc, heavy Ppt. | |
| 10 | 2,2'-dihydroxy-4-methoxy-benzophenone | Clear | Slightly hazy | Suspended Floc, heavy Ppt. | |
| 11 | 2-(2'-hydroxy-5'-methyl-phenyl)benzotriazole | Clear | Hazy | Suspended Floc, heavy Ppt. | |

Table II shows the results obtained employing 0.5 weight percent additives in the above-described hydrocracked base oil of Table I. Here, also, it will be noted from the table, that, when subjected to the above-described test, the above described nickel complexes in the lubricant compositions of the present invention are much more markedly effective against ultra-violet degradation (Example 2–4) than the best of the aforementioned commercially available conventional antioxidants and ultra-violet absorbers (Example 5–9).

Table III shows the effectiveness of a typically representative nickel complex of the present invention, viz, nickel phenol-phenolate of t-octylphenol sulfide in a "200" hydrocracked base oil (Base oil 1) and also in another base oil (Base oil 2) viz a heavy vacuum gas oil. As shown in the table, the nickel phenol-phenolate of t-octyl-phenol sulfide of the present invention was markedly effective in reducing the ultra-violet degradation of the respective base oils.

TABLE II

| Ex. | Additive | Daylight Exposure Tests of Hydrocracked Base Stock Containing 0.5 Wt. % Additives — Number of Days/Condition: 1 | 4 | 8 | 12 | 18 | 22 | 25 |
|---|---|---|---|---|---|---|---|---|
| 1 | None (Base oil) | Slightly hazy | Hazy, hvy ppt. | | | | | |
| 2 | Nickel phenol-phenolate of t-octylphenol sulfide (6.0 wt. % Ni) | Clear | Clear | Clear | Clear | Clear | Clear | Hazy, Lt. ppt. |
| 3 | Nickel di(4-methyl-2-pentyl)dithiophosphate | Clear | Slightly hazy | Slightly hazy, medium ppt. | Slightly hazy, medium ppt. | Lt. suspended floc, hvy ppt. | | |
| 4 | [2,2'-thio-bis(4-tert-octylphenolato]-n-butylamine nickel | Clear | Slightly hazy | Suspended floc, hvy ppt. | | | | |
| 5 | Di-t-butyl para cresol | Clear | Suspended floc, medium ppt. | | | | | |
| 6 | Phenyl alpha-naphthylamine | Clear | Suspended floc, medium ppt. | | | | | |
| 7 | Zinc di(4-methyl 2-pentyl) dithiophosphate | Clear | Very slightly hazy | Hazy, medium ppt. | Lt. suspended floc, hvy ppt. | | | |
| 8 | 2,2'-dihydroxy-4-methoxy-benzophenone | Clear | Slightly hazy | Hazy, hvy ppt. | | | | |
| 9 | 2-(2'-hydroxy-5'-methyl-phenyl)benzotriazole | Clear | Hazy | Hazy, hvy ppt. | | | | |

TABLE III

| Ex. | Additive | Daylight Exposure Tests of Hydrocracked Oils Containing Nickel phenol-phenolate of t-octylphenol sulfide — Number of Days/Condition: 1 | 4 | 8 | 12 | 18 | 20 |
|---|---|---|---|---|---|---|---|
| 1 | None (Base oil 1) | Clear | Slightly hazy, hvy ppt. | Hazy, hvy ppt. | | | |
| 2 | 0.5% nickel phenol-phenolate of t-octyl-phenol sulfide (6.0 wt. % Ni) | Clear | Very slightly hazy | Very slightly hazy | Very slightly hazy | Very slightly hazy, trace ppt. | Very slightly hazy, trace ppt. |
| 3 | 0.1% nickel phenol-phenolate of t-octyl-phenol sulfide (6.0 wt. % Ni) | Clear | Very slightly hazy | Very slightly hazy | Very slightly hazy | Suspended floc, hvy ppt. | |

TABLE III-continued

| Ex. | Additive | Daylight Exposure Tests of Hydrocracked Oils Containing Nickel phenol-phenolate of t-octylphenol sulfide Number of Days/Condition 1 | 2 | 3 | 4 |
|---|---|---|---|---|---|
| 4 | None (Base oil 2) | Hazy, suspended floc, hvy ppt. | | | |
| 5 | 0.5% nickel phenol-phenolate of t-octyl phenol sulfide (6.0 wt. % Ni) | Very slightly hazy, trace ppt. | Very slightly hazy, trace ppt. | Slightly hazy, trace ppt. | Hazy, trace ppt. |

In the following Table IV is shown the effectiveness of typically representative nickel complexes of the present invention, as antioxidants in lubricant compositions. The representative additives were individually blended in 150" solvent-refined paraffinic mineral oil and were subjected to the standard Rotary Bomb Oxidation Test in accordance with test method ASTM D-2272.

As will be noted from the table, the oxidation life of the base oil was markedly increased by the antioxidant effect imparted by the nickel complexes of the present invention.

TABLE IV

| Ex. | Antioxidant Effects of Nickel Complexes | RBOT Life, Minutes |
|---|---|---|
| 1 | None (Base Oil) | 37 |
| 2 | 1% (2,2'-thio-bis(4-tert-octylphenolato)-n-butylamine nickel | 60 |
| 3 | 1% Nickel phenol-phenolate of t-octylphenol sulfide (6.0 wt % Ni) | 80 |
| 4 | 1% nickel di(4-methyl-2-pentyl) dithiophosphate | 180 |
| 5 | 0.25% nickel dibutyl-dithiocarbamate | 230 |

While this invention has been described with reference to preferred compositions and components therefor, it will be understood by those skilled in the art that departure from the preferred embodiments can be effectively made and are within the scope of the specification.

We claim:

1. A lubricant composition comprising a major amount of a mineral oil or a fraction thereof of lubricating viscosity and a minor amount effective for stabilizing said composition against ultra-violet degradation of an organo-nickel complex which is a suitable amine complex of a nickel alkylphenolate sulfide; said alkyl groups having from 1 to about 30 carbon atoms said amine selected from the group consisting of primary aliphatic amines, primary aromatic amines and cyclic secondary amines.

2. The lubricant composition defined in claim 1 wherein the nickel complex is present in an amount from about 0.01 to about 5% by weight.

3. The lubricant composition defined in claim 1 wherein the nickel complex is present in an amount from about 0.1 to about 2%, by weight.

4. The lubricant composition defined in claim 1 wherein said lubricant comprises a hydrocracked lubricating oil.

5. The lubricant composition defined in claim 1 wherein said lubricant comprises a hydraulic oil.

6. The lubricant composition defined in claim 1 wherein said lubricant comprises a wax.

7. The lubricant composition defined in claim 1 wherein said lubricant comprises a grease.

8. The lubricant composition defined in claim 1 wherein the organo-nickel complex is a $C_1$-$C_{30}$ alkyl amine complex of an alkylphenolate of t-octylphenol sulfide.

9. The lubricant composition defined in claim 8 wherein the said complex is [2-2'-thiobis(4-tert-octylphenolato)]-n-butyl amine nickel.

* * * * *